US011742127B2

(12) United States Patent
Miyake et al.

(10) Patent No.: US 11,742,127 B2
(45) Date of Patent: Aug. 29, 2023

(54) INDUCTOR COMPONENT

(71) Applicant: Murata Manufacturing Co., Ltd., Kyoto-fu (JP)

(72) Inventors: Isamu Miyake, Nagaokakyo (JP); Shinya Hirai, Nagaokakyo (JP); Akinori Hamada, Nagaokakyo (JP); Ryuichiro Tominaga, Nagaokakyo (JP); Koichi Yamaguchi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 331 days.

(21) Appl. No.: 16/943,134

(22) Filed: Jul. 30, 2020

(65) Prior Publication Data

US 2021/0065950 A1 Mar. 4, 2021

(30) Foreign Application Priority Data

Aug. 27, 2019 (JP) ..... 2019-154523

(51) Int. Cl.
*H01F 17/00* (2006.01)
*H01F 27/32* (2006.01)
(Continued)

(52) U.S. Cl.
CPC ..... *H01F 17/0013* (2013.01); *H01F 17/04* (2013.01); *H01F 27/292* (2013.01); *H01F 27/32* (2013.01); *H01F 2017/048* (2013.01)

(58) Field of Classification Search
CPC .... H01F 17/0013; H01F 17/04; H01F 27/292; H01F 27/32; H01F 2017/048
See application file for complete search history.

(56) References Cited

U.S. PATENT DOCUMENTS 11,152,153 B2 * 10/2021 Cha ..... H01G 4/0085
2004/0175569 A1 * 9/2004 Uchida ..... B22F 1/16 428/403

(Continued)

FOREIGN PATENT DOCUMENTS

CN 110136921 A 8/2019
JP 2002217016 A 8/2002

(Continued)

OTHER PUBLICATIONS

An Office Action mailed by China National Intellectual Property Administration dated Dec. 23, 2021 which corresponds to Chinese Patent Application No. 202010656406.0 and is related to U.S. Appl. No. 16/943,134 with English language translation.

(Continued)

*Primary Examiner* — Marlon T Fletcher
*Assistant Examiner* — Malcolm Barnes
(74) *Attorney, Agent, or Firm* — Studebaker & Brackett PC

(57) ABSTRACT

An inductor component includes a base body, a first coil line and a second coil line, a first substantially columnar line and a second substantially columnar line, and a third substantially columnar line and a fourth substantially columnar line. The first substantially columnar line is located closer to the third substantially columnar line than the fourth substantially columnar line. A minimum distance X1 between the first substantially columnar line and the third substantially columnar line is shorter than a minimum distance Y between a first portion of the first coil line and a second portion of the second coil line.

19 Claims, 2 Drawing Sheets

(51) Int. Cl.
*H01F 27/29* (2006.01)
*H01F 17/04* (2006.01)

(56) References Cited

U.S. PATENT DOCUMENTS

| | | | | |
|---|---|---|---|---|
| 2017/0345551 | A1* | 11/2017 | Yoshioka | H01F 17/04 |
| 2018/0075965 | A1* | 3/2018 | Yoshioka | H01F 27/2823 |
| 2019/0198225 | A1* | 6/2019 | Miyoshi | H01F 27/292 |
| 2019/0206611 | A1* | 7/2019 | Matsumoto | H01F 17/04 |
| 2019/0244743 | A1 | 8/2019 | Hirai et al. | |

FOREIGN PATENT DOCUMENTS

| | | | | |
|---|---|---|---|---|
| JP | 2016115448 | A * | 6/2016 | C09D 5/24 |
| JP | 2019-121780 | A | 7/2019 | |

OTHER PUBLICATIONS

An Office Action; "Notice of Reasons for Refusal," mailed by the Japanese Patent Office dated Apr. 5, 2022, which corresponds to Japanese Patent Application No. 2019-154523 and is related to U.S. Appl. No. 16/943,134 with English language translation.

* cited by examiner

INDUCTOR COMPONENT

CROSS-REFERENCE TO RELATED APPLICATION

This application claims benefit of priority to Japanese Patent Application No. 2019-154523, filed Aug. 27, 2019, the entire content of which is incorporated herein by reference.

BACKGROUND

Technical Field

The present disclosure relates to an inductor component.

Background Art

Hitherto, a component disclosed in Japanese Unexamined Patent Application Publication No. 2002-217016 has been known as an inductor component. The inductor component include a base body, a first coil line and a second coil line, each being disposed in the base body and parallel to a first main surface of the base body, a first extended line and a second extended line, each being buried in the base body, having an end face exposed at a side face of the base body, and being electrically connected to the first coil line, and a third extended line and a fourth extended line, each being buried in the base body, having an end face exposed at a side face of the base body, and being electrically connected to the second coil line.

SUMMARY

When such inductor components of the related art were actually produced, the following problems were found.

In production processes of inductor components, electrostatic breakdowns of base bodies may occur. In this case, it was found that in such an inductor component of the related art, an electrostatic breakdown of a base body occurs between a first coil line and a second coil line. The distance where the first coil line and the second coil line arrange side by side is long; thus, it is difficult to identify the location of a portion of the base body where an electrostatic breakdown occurs.

Accordingly, the present disclosure provides an inductor component in which when an electrostatic breakdown occurs in a base body, the location of the damaged portion of the base body is easily identified and is easily corrected.

According to one aspect of the present disclosure, an inductor component includes a base body, a first coil line and a second coil line, each being disposed in the base body and parallel to a first main surface of the base body, a first substantially columnar line and a second substantially columnar line, each being buried in the base body, having an end face exposed at a first main surface of the base body, and being electrically connected to the first coil line, and a third substantially columnar line and a fourth substantially columnar line, each being buried in the base body, having an end face exposed at the first main surface of the base body, and being electrically connected to the second coil line. The first substantially columnar line is located closer to the third substantially columnar line than the fourth substantially columnar line, and the minimum distance X1 between the first substantially columnar line and the third substantially columnar line is shorter than the minimum distance Y between a first portion of the first coil line and a second portion of the second coil line. The first portion of the first coil line is located between the first substantially columnar line and the second substantially columnar line when viewed from a direction perpendicular to the first main surface. The second portion of the second coil line is located between the third substantially columnar line and the fourth substantially columnar line when viewed from the direction perpendicular to the first main surface.

The minimum distance X1 between the first substantially columnar line and the third substantially columnar line is shorter than the minimum distance Y between the first portion of the first coil line and the second portion of the second coil line. This leads to a higher probability of the occurrence of an electrostatic breakdown in a portion of the base body between the first substantially columnar line and the third substantially columnar line than that in a portion of the base body between the first portion of the first coil line and the second portion of the second coil line.

In the case where an electrostatic breakdown occurs between the first substantially columnar line and the third substantially columnar line, the damaged portion of the base body is easily corrected by drilling a hole in the damaged portion with, for example, a laser and then sealing the hole with an insulating resin, such as an acrylic resin.

Thus, when an electrostatic breakdown occurs in the base body, the location of the damaged portion of the base body is easily identified and is easily corrected.

In the inductor component according to an embodiment, the minimum distance X1 may be about 0.8 or less times the minimum distance Y.

In this case, the electrostatic breakdown of the base body can be allowed to occur more reliably between the first substantially columnar line and the third substantially columnar line.

In the inductor component according to an embodiment, a distance Ly where the first portion of the first coil line and the second portion of the second coil line arrange side by side with the minimum distance Y maintained therebetween may be longer than a distance L1 where the first substantially columnar line and the third substantially columnar line arrange side by side with the minimum distance X1 maintained therebetween.

In this case, when the distance Ly is long, it is difficult to identify the location of a damaged portion when an electrostatic breakdown occurs between the first coil line and the second coil line; however, because an electrostatic breakdown occurs easily between the first substantially columnar line and the third substantially columnar line, the location of the damaged portion is easily identified.

In the inductor component according to an embodiment, the distance Ly may be about five or more times the distance L1.

In this case, the distance Ly is five or more times the distance L1. This further enhances the effect of enabling an electrostatic breakdown to occur easily between the first substantially columnar line and the third substantially columnar line.

In the inductor component according to an embodiment, the base body may include a magnetic layer composed of a resin containing a magnetic metal powder at least between the first portion of the first coil line and the second portion of the second coil line.

In this case, the magnetic layer containing a magnetic metal powder is susceptible to a dielectric breakdown. This further enhances the effect of enabling an electrostatic breakdown to occur easily between the first substantially columnar line and the third substantially columnar line.

In the inductor component according to an embodiment, the base body may include an insulating layer containing no magnetic material between the first portion of the first coil line and the second portion of the second coil line.

In this case, the insulating layer is provided between the first portion of the first coil line and the second portion of the second coil line; thus, it is possible to further prevent the occurrence of an electrostatic breakdown between the first portion of the first coil line and the second portion of the second coil line.

In the inductor component according to an embodiment, a minimum distance X2 between the second substantially columnar line and the fourth substantially columnar line may be shorter than the minimum distance Y between the first portion of the first coil line and the second portion of the second coil line.

In this case, even if static electricity is applied from a side on which the second substantially columnar line and the fourth substantially columnar line lie, an electrostatic breakdown occurs easily between the second substantially columnar line and the fourth substantially columnar line. This facilitates the identification of the location of a damaged portion to enable the lines to be routed more freely.

In the inductor component according to an embodiment, each of the first coil line and the second coil line may contain sulfur atoms or chlorine atoms in an amount of about 0.1 atom % or more and about 1 atom % or less (i.e., from about 0.1 atom % to about 1 atom %).

In this case, the first coil line and the second coil line are formed by a semi-additive process, thus providing high accuracy of the formation position and shape and small variations.

In the inductor component according to an embodiment, each of the first substantially columnar line, the second substantially columnar line, the third substantially columnar line, and the fourth substantially columnar line may extend in a direction perpendicular to the first main surface.

In this case, it is possible to increase regions of the substantially columnar lines where the minimum distances are maintained therebetween, thereby enabling an electrostatic breakdown to occur more reliably between the substantially columnar lines.

Other features, elements, characteristics and advantages of the present disclosure will become more apparent from the following detailed description with reference to the attached drawings.

DETAILED DESCRIPTION

An inductor component according to an embodiment of the present disclosure will be described in detail below with reference to the attached drawings. The drawings include some schematic ones and may not reflect actual dimensions or proportions.

First Embodiment

Configuration

Figure 1A:
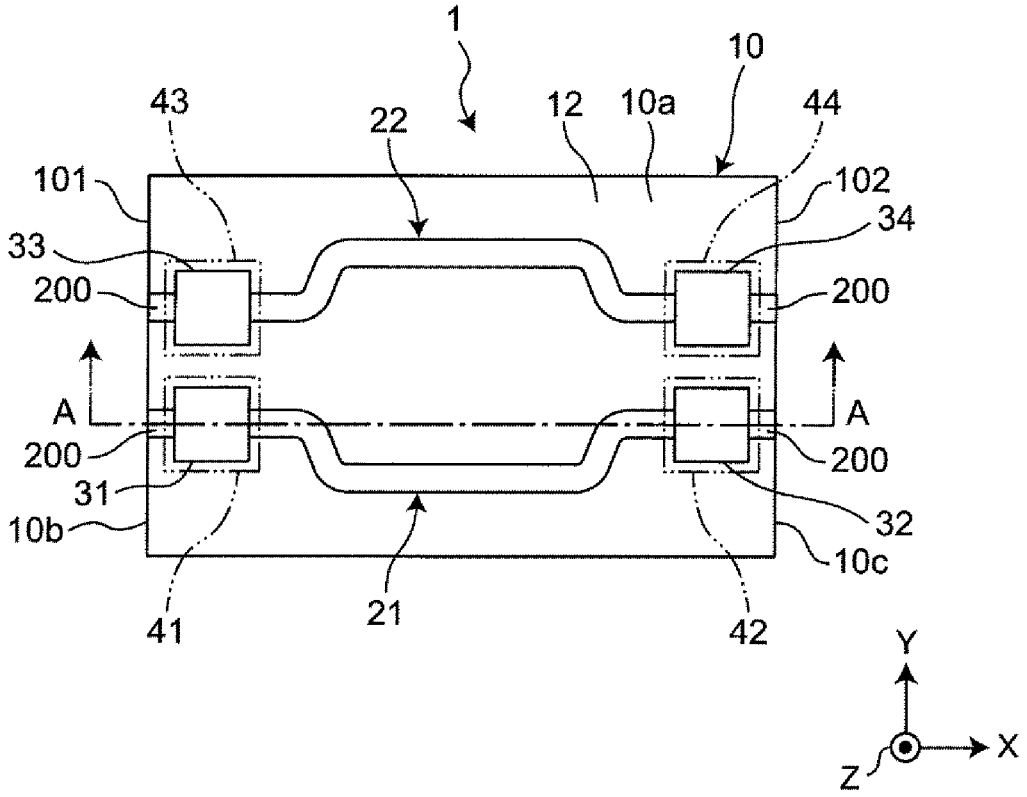
FIG. 1A is a perspective plan view of an inductor component according to a first embodiment.
Figure 1B:
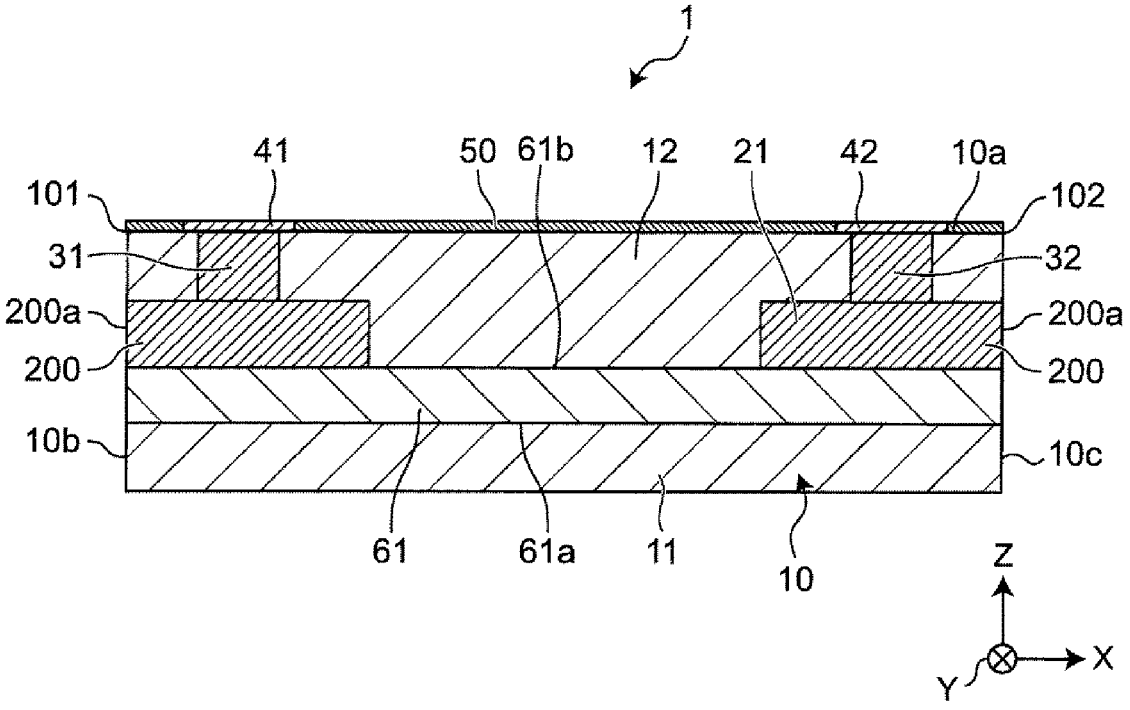
FIG. 1B is a cross-sectional view taken along line IB-IB of FIG. 1A.

FIG. 1A is a perspective plan view of an inductor component according to a first embodiment. FIG. 1B is a cross-sectional view taken along line IB-IB of FIG. 1A.

An inductor component 1 is, for example, a component mounted on a circuit board installed in an electronic device, such as a personal computer, a digital versatile disc (DVD) player, a digital camera, a television (TV) set, a cellular phone, or an automotive electronic system and is, for example, a substantially rectangular parallelepiped component as a whole. The shape of the inductor component 1 may be, but is not particularly limited to, a substantially cylindrical shape, a substantially polygonal columnar shape, a substantially truncated cone shape, or a substantially truncated polygonal pyramid shape.

As illustrated in FIGS. 1A and 1B, the inductor component 1 includes a base body 10; a first coil line 21 and a second coil line 22 disposed in the base body 10; a first substantially columnar line 31, a second substantially columnar line 32, a third substantially columnar line 33, and a fourth substantially columnar line 34, each being buried in the base body 10 and having an end face exposed at a first main surface 10*a* of the base body 10; a first external terminal 41, a second external terminal 42, a third external terminal 43, and a fourth external terminal 44 that are disposed at the first main surface 10*a* of the base body 10; and an insulating film 50 on the first main surface 10*a* of the base body 10. In the drawings, the thickness direction of the inductor component 1 is defined as a Z direction. The positive Z direction is defined as an upward direction. The negative Z direction is defined as a downward direction. In a plane of the inductor component 1 perpendicular to the Z direction, the longitudinal direction of the inductor component 1 is defined as an X direction, and the lateral direction of the inductor component 1 is defined as a Y direction.

The base body 10 includes an insulating layer 61, a first magnetic layer 11 disposed on the lower surface 61*a* of the insulating layer 61, and a second magnetic layer 12 disposed on the upper surface 61*b* of the insulating layer 61. The first main surface 10*a* of the base body 10 corresponds to the upper surface of the second magnetic layer 12. The base body 10 has a three-layer structure including the insulating layer 61, the first magnetic layer 11, and the second magnetic layer 12, but may have a structure having no magnetic layer.

The insulating layer 61 is a layer having a substantially rectangular main surface. The insulating layer 61 has a thickness of, for example, about 10 μm or more and about 100 μm or less (i.e., from about 10 μm to about 100 μm). The insulating layer 61 is preferably, for example, an insulating resin layer composed of an epoxy resin or a polyimide resin containing no base material, such as glass cloth, from the viewpoint of reducing the profile. However, the insulating layer 61 may be formed of a sintered body of a magnetic layer composed of, for example, NiZn- or MnZn-based ferrite or a non-magnetic layer composed of, for example, alumina or glass, or may be formed of a resin layer containing a base material such as a glass-epoxy material. When the insulating layer 61 is formed of a sintered body, the insulating layer 61 can have high strength and good flatness, thus improving the processability of a stacked material on the insulating layer 61. Additionally, when the insulating layer 61 is formed of a sintered body, the insulating layer 61 is preferably ground, particularly preferably ground from the undersurface on which no stacked material is present, from the viewpoint of reducing the profile.

The first magnetic layer 11 and the second magnetic layer 12 are magnetic resin layers composed of a resin containing a magnetic metal powder. The resin is an organic insulating material, such as an epoxy-based resin, bismaleimide, a liquid crystal polymer, or polyimide. The magnetic metal powder has an average particle size of, for example, about 0.1 μm or more and about 5 μm or less (i.e., from about 0.1 μm to about 5 μm). In a production process of the inductor component 1, the average particle size of the magnetic metal powder can be calculated as a particle size corresponding to a 50% cumulative value in a particle size distribution determined by a laser diffraction/scattering method. The magnetic metal powder is composed of, for example, an FeSi-based alloy, e.g., FeSiCr, an FeCo-based alloy, an Fe-based alloy, e.g., NiFe, or an amorphous alloy thereof. The magnetic metal powder content is preferably about 20% by volume or more and 70% by volume or less (i.e., from about 20% by volume to 70% by volume) based on the entire magnetic layer. When the magnetic metal powder has an average particle size of about 5 μm or less, the direct current superposition characteristics are further improved, and the use of the fine powder enables a reduction in iron loss at high frequencies. A magnetic powder composed of a NiZn- or MnZn-based ferrite may be used instead of the magnetic metal powder.

The first coil line 21 and the second coil line 22 are parallel to the first main surface 10*a* of the base body 10. Thus, the first coil line 21 and the second coil line 22 can be configured in a direction parallel to the first main surface 10*a* to enable a reduction in the profile of the inductor component 1. The first coil line 21 and the second coil line 22 are disposed on the same plane in the base body 10. Specifically, the first coil line 21 and the second coil line 22 are disposed only on the upper side of the insulating layer 61, i.e., the upper surface 61*b* of the insulating layer 61, and are covered with the second magnetic layer 12.

Each of the first and second coil lines 21 and 22 is wound in a plane. Specifically, each of the first and second coil lines 21 and 22 has a substantially semi-elliptical arc shape when viewed from the Z direction. That is, each of the first and second coil lines 21 and 22 is a curved line wound about a half turn. Additionally, each of the first and second coil lines 21 and 22 includes a straight portion in an intermediate section.

Each of the first and second coil lines 21 and 22 preferably has a thickness of, for example, about 40 μm or more and 120 μm or less (i.e., from about 40 μm to 120 μm). In some embodiments, each of the first and second coil lines 21 and 22 has a thickness of about 45 μm, a line width of about 40 μm, and a line spacing of about 10 μm. The line spacing is preferably about 3 μm or more and 20 μm or less (i.e., from about 3 μm to 20 μm).

Each of the first and second coil lines 21 and 22 is composed of a conductive material and, for example, a low-electrical-resistance metal material, such as Cu, Ag, Au, or Al. In this embodiment, the inductor component 1 includes only a single layer of the first and second coil lines 21 and 22, thereby enabling a reduction in the profile of the inductor component 1.

The first coil line 21 has a first end portion and a second end portion that are electrically connected to the first substantially columnar line 31 and the second substantially columnar line 32, respectively, located at outer side portions, and is curved in a substantially arc from the first and second substantially columnar lines 31 and 32 toward the center of the inductor component 1. The first coil line 21 has pad portions having a larger line width than the substantially coil-shaped portion at both end portions thereof and is directly connected to the first and second substantially columnar lines 31 and 32 at the pad portions.

Similarly, the second coil line 22 has a first end portion and a second end portion that are electrically connected to the third substantially columnar line 33 and the fourth substantially columnar line 34, respectively, located at outer side portions, and is curved in a substantially arc from the third and fourth substantially columnar lines 33 and 34 toward the center of the inductor component 1.

Here, in each of the first and second coil lines 21 and 22, a range surrounded by a curve of the first or second coil line 21 or 22 and a straight line connecting both end portions of the first or second coil line 21 or 22 is defined as an inside diameter portion. The inside diameter portions of the first and second coil lines 21 and 22 do not overlap with each other when viewed from the Z direction. The substantially arc portions of the first and second coil lines 21 and 22 are separated from each other.

Lines extend from connection positions of the first and second coil lines 21 and 22 and the first to fourth substantially columnar lines 31 to 34 toward the outer side portions of the chip. The lines are exposed at the outer side portions of the chip. That is, the first and second coil lines 21 and 22 have exposed portions 200 each exposed to the outside at a side surface parallel to the stacking direction of the inductor component 1.

The lines are used to be coupled to a feeding line when additional electroplating is performed after the formation of the shapes of the first and second coil lines 21 and 22 in the production process of the inductor component 1. The use of the feeding line enables easy implementation of additional electroplating in a state of an inductor substrate before the singulation of the inductor substrate into individual inductor components 1, thereby reducing the distance between the lines. The implementation of the additional electroplating can reduce the distance between the first and second coil lines 21 and 22 to enhance the magnetic coupling between the first and second coil lines 21 and 22.

The first and second coil lines 21 and 22 have the exposed portions 200 and thus can be highly resistant to an electrostatic breakdown during the processing of the inductor substrate. In each of the first and second coil lines 21 and 22, the thickness of the exposed surface 200*a* of each of the exposed portions 200 is preferably equal to or less than the thickness of each of the first and second coil lines 21 and 22 and about 45 μm or more. In this case, since the thickness of each exposed surface 200*a* is equal to or less than the thickness of each of the first and second coil lines 21 and 22, the proportions of the magnetic layers 11 and 12 can be increased to improve the inductance. Since the thickness of each exposed surface 200*a* is about 45 μm or more, the occurrence of disconnection can be reduced. Each exposed surface 200*a* is preferably formed of an oxide film. In this case, a short circuit can be suppressed between the inductor component 1 and its adjacent component.

The first to fourth substantially columnar lines 31 to 34 extend in the Z direction from the first and second coil lines 21 and 22 and penetrate through the inside of the second magnetic layer 12. The first substantially columnar line 31 extends upward from the upper surface of one end portion of the first coil line 21. An end face of the first substantially columnar line 31 is exposed at the first main surface 10*a* of the base body 10. The second substantially columnar line 32 extends upward from the upper surface of the other end portion of the first coil line 21. An end face of the second substantially columnar line 32 is exposed at the first main surface 10*a* of the base body 10.

The third substantially columnar line 33 extends upward from the upper surface of one end portion of the second coil line 22. An end face of the third substantially columnar line 33 is exposed at the first main surface 10*a* of the base body 10. The fourth substantially columnar line 34 extends upward from the upper surface of the other end portion of the second coil line 22. An end face of the fourth substantially columnar line 34 is exposed at the first main surface 10*a* of the base body 10. The first substantially columnar line 31 is located closer to the third substantially columnar line 33 than the fourth substantially columnar line 34.

The first substantially columnar line 31, the second substantially columnar line 32, the third substantially columnar line 33, and the fourth substantially columnar line 34 extend linearly from the first coil line 21 and the second coil line 22 to the end faces exposed at the first main surface 10*a* in a direction perpendicular to the first main surface 10*a*. Thereby, the first external terminal 41, the second external terminal 42, the third external terminal 43, and the fourth external terminal 44 can be connected to the first coil line 21 and the second coil line 22 at a shorter distance, thus enabling the inductor component 1 to have lower resistance and higher inductance. The first to fourth substantially columnar lines 31 to 34 are composed of a conductive material and, for example, the same material as that of the first and second coil lines 21 and 22. The first to fourth substantially columnar lines 31 to 34 may be electrically connected to the first and second coil lines 21 and 22 with via conductors (not illustrated).

The first to fourth external terminals 41 to 44 are disposed on the first main surface 10*a* of the base body 10 (the upper surface of the second magnetic layer 12). Each of the first to fourth external terminals 41 to 44 is composed of a conductive material and, for example, has a three-layer structure in which a Cu layer having low electrical resistance and excellent stress resistance, a Ni layer having excellent corrosion resistance, and a Au layer excellent in wettability and reliability are arranged in this order from the inner side portion to the outer side portion.

The first external terminal 41 is in contact with the end face of the first substantially columnar line 31 exposed at the first main surface 10*a* of the base body 10 and electrically connected to the first substantially columnar line 31. Thereby, the first external terminal 41 is electrically connected to one end portion of the first coil line 21. The second external terminal 42 is in contact with the end face of the second substantially columnar line 32 exposed at the first main surface 10*a* of the base body 10 and electrically connected to the second substantially columnar line 32. Thereby, the second external terminal 42 is electrically connected to the other end portion of the first coil line 21.

Similarly, the third external terminal 43 is in contact with the end face of the third substantially columnar line 33, electrically connected to the third substantially columnar line 33, and electrically connected to one end portion of the second coil line 22. The fourth external terminal 44 is in contact with the end face of the fourth substantially columnar line 34, electrically connected to the fourth substantially columnar line 34, and electrically connected to the other end portion of the second coil line 22. The first external terminal 41 is located closer to the third external terminal 43 than the fourth external terminal 44.

The first main surface 10*a* of the inductor component 1 has a first end edge 101 and a second end edge 102 that extend linearly and that correspond to sides of a substantially rectangular shape. The first end edge 101 and the second end edge 102 are end edges of the first main surface 10*a* connected to a first side surface 10*b* and a second side surface 10*c*, respectively, of the base body 10. The first external terminal 41 and the third external terminal 43 are arranged along the first end edge 101 adjacent to the first side surface 10*b* of the base body 10. The second external terminal 42 and the fourth external terminal 44 are arranged along the second end edge 102 adjacent to the second side surface 10*c* of the base body 10. The first side surface 10*b* and the second side surface 10*c* of the base body 10 extend in the Y direction and coincide with the first end edge 101 and the second end edge 102, respectively, when viewed from a direction perpendicular to the first main surface 10*a* of the base body 10. The arrangement direction of the first external terminal 41 and the third external terminal 43 is a direction connecting the center of the first external terminal 41 and the center of the third external terminal 43. The arrangement direction of the second external terminal 42 and the fourth external terminal 44 is a direction connecting the center of the second external terminal 42 and the center of the fourth external terminal 44.

The insulating film 50 is disposed on a portion of the first main surface 10*a* of the base body 10 where the first to fourth external terminals 41 to 44 are not disposed. However, end portions of the first to fourth external terminals 41 to 44 may extend on portions of the insulating film 50, so that the portions of the insulating film 50 may overlap the end portions of the first to fourth external terminals 41 to 44. The insulating film 50 is composed of a resin material, such as an acrylic resin, an epoxy-based resin, or polyimide, having high electrical insulating properties. This can improve the insulation among the first to fourth external terminals 41 to 44. The insulating film 50 serves as a mask used for the pattern formation of the first to fourth external terminals 41 to 44 to improve the production efficiency. When the magnetic metal powder is exposed at a surface of the resin, the insulating film 50 can cover the exposed magnetic metal powder to prevent the exposure of the magnetic metal powder to the outside. The insulating film 50 may contain a filler composed of an insulating material.

Figure 2:
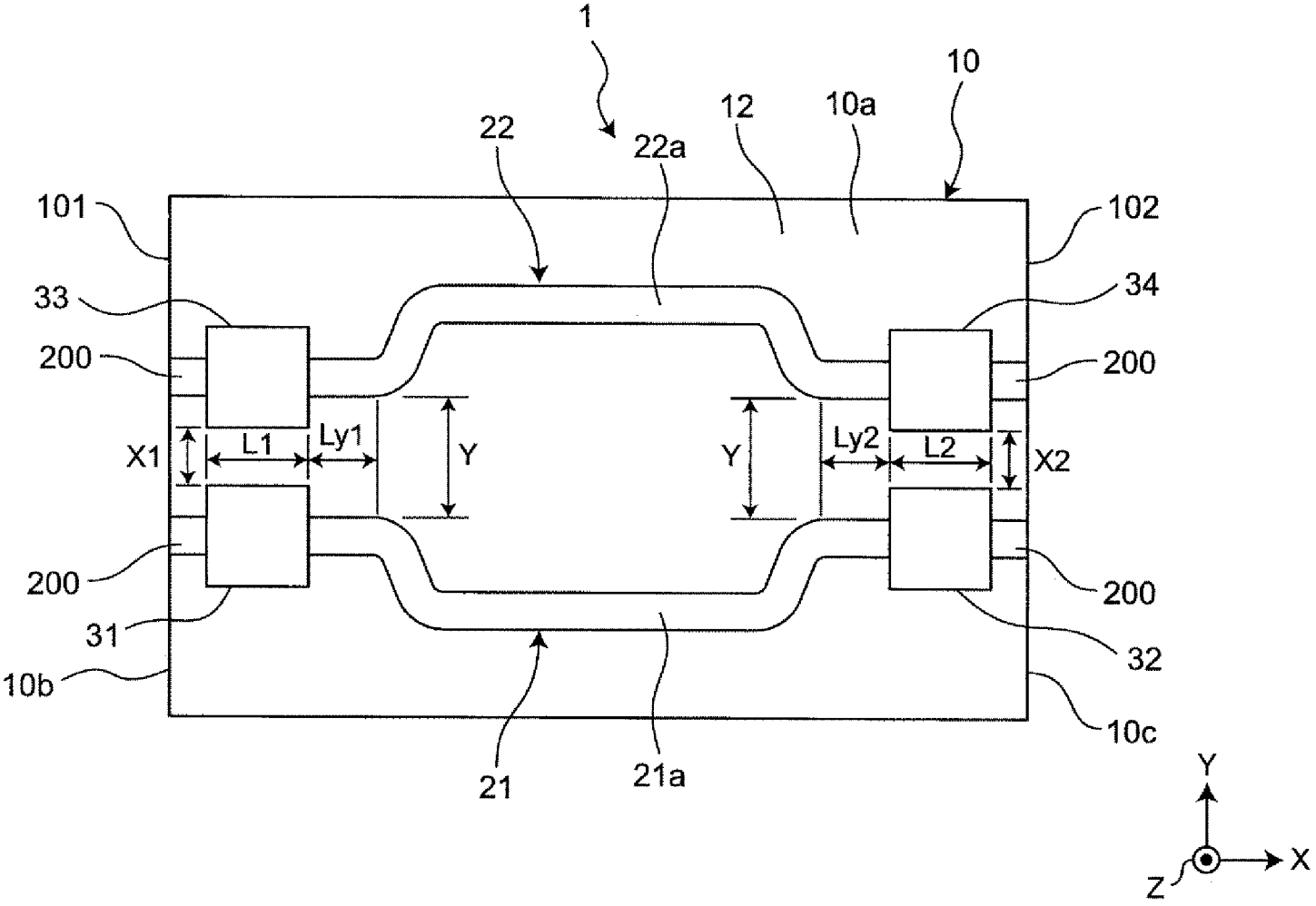
FIG. 2 is a plan view illustrating distances in an inductor component.

As illustrated in FIG. 2, the minimum distance X1 between the first substantially columnar line 31 and the third substantially columnar line 33 is shorter than the minimum distance Y between a first portion 21*a* of the first coil line 21 and a second portion 22*a* of the second coil line 22, the first portion 21*a* being located between the first substantially columnar line 31 and the second substantially columnar line 32 when viewed from a direction perpendicular to the first main surface 10*a*, the second portion 22*a* being located between the third substantially columnar line 33 and the fourth substantially columnar line 34 when viewed from the direction perpendicular to the first main surface 10*a*.

This leads to a higher probability of the occurrence of an electrostatic breakdown in a portion of the base body 10 between the first substantially columnar line 31 and the third substantially columnar line 33 than that in a portion of the base body 10 between the first portion 21*a* of the first coil line 21 and the second portion 22*a* of the second coil line 22. In the case where an electrostatic breakdown occurs between the first substantially columnar line 31 and the third substantially columnar line 33, the damaged portion of the base body 10 is easily corrected by drilling a hole in the damaged portion with, for example, a laser and then sealing the hole with an insulating resin, such as an acrylic resin. Thus, when an electrostatic breakdown occurs in the base body 10, the location of the damaged portion of the base body 10 is easily identified and is easily corrected.

The effect of the portion between the first substantially columnar line 31 and the third substantially columnar line 33 on the characteristics is relatively smaller than that of the portion between the first coil line 21 and the second coil line 22. Thus, when the hole is sealed with the insulating resin, the effect on the inductance value is small.

The exposed portions 200 of the first and second coil lines 21 and 22, which are located closer to the outside than the first and third substantially columnar lines 31 and 33, are not main paths through which current flows; thus, an electrostatic breakdown does not easily occur. The minimum distance between the exposed portion 200 of the first coil line 21 and the exposed portion 200 of the second coil line 22 may be shorter than the minimum distance X1 between the first substantially columnar line 31 and the third substantially columnar line 33.

Preferably, the minimum distance X1 between the first substantially columnar line 31 and the third substantially columnar line 33 may be shorter than the minimum distance between the exposed portion 200 of the first coil line 21 and the exposed portion 200 of the second coil line 22. The aspect ratio of a photoresist during the formation of the lines is not excessively large on the exposed portion 200 side; thus, a decrease in production yield can be suppressed.

The minimum distance X1 is preferably 0.8 or less times the minimum distance Y. In this case, the electrostatic breakdown of the base body 10 can be allowed to occur more reliably between the first substantially columnar line 31 and the third substantially columnar line 33.

The distance Ly where the first portion 21*a* of the first coil line 21 and the second portion 22*a* of the second coil line 22 arrange side by side with the minimum distance Y maintained therebetween is preferably longer than a distance L1 where the first substantially columnar line 31 and the third substantially columnar line 33 arrange side by side with the minimum distance X1 maintained therebetween. The distance Ly is the total of a distance Ly1 on a side on which the first and third substantially columnar lines 31 and 33 lie and a distance Ly2 on a side on which the second and fourth substantially columnar line 32 and 34 lie. The shape of each of the first substantially columnar line 31 and the third substantially columnar line 33 is a rectangle when viewed from the Z direction; thus, the distance L1 corresponds to the length of a side of the rectangle. In this case, when the distance Ly is long, it is difficult to identify the location of a damaged portion when an electrostatic breakdown occurs between the first coil line 21 and the second coil line 22; however, because an electrostatic breakdown occurs easily between the first substantially columnar line 31 and the third substantially columnar line 33, the location of the damaged portion is easily identified.

The distance Ly is preferably two or more times the distance L1, more preferably five or more times the distance L1. In this case, the distance Ly is two or more times the distance L1, preferably five or more times the distance LL Thus, this further enhances the effect of enabling an electrostatic breakdown to occur easily between the first substantially columnar line 31 and the third substantially columnar line 33. At an excessively long distance Ly, the inductor component 1 is increased in size.

The base body 10 preferably includes the second magnetic layer 12 composed of a resin containing a magnetic metal powder between the first portion 21*a* of the first coil line 21 and the second portion 22*a* of the second coil line 22. In this case, the second magnetic layer 12 containing a magnetic metal powder is susceptible to a dielectric breakdown. This further enhances the effect of enabling an electrostatic breakdown to occur easily between the first substantially columnar line 31 and the third substantially columnar line 33. The second magnetic layer 12 may be disposed in at least a portion between the first portion 21*a* of the first coil line 21 and the second portion 22*a* of the second coil line 22.

The base body 10 preferably includes an insulating layer containing no magnetic material between the first portion 21*a* of the first coil line 21 and the second portion 22*a* of the second coil line 22. In this case, it is possible to further prevent the occurrence of an electrostatic breakdown between the first portion 21*a* of the first coil line 21 and the second portion 22*a* of the second coil line 22. The insulating layer may be disposed in at least a portion between the first portion 21*a* of the first coil line 21 and the second portion 22*a* of the second coil line 22. The insulating layer need not be in contact with the first coil line 21 or the second coil line 22.

A minimum distance X2 between the second substantially columnar line 32 and the fourth substantially columnar line 34 is preferably shorter than the minimum distance Y between the first portion 21*a* of the first coil line 21 and the second portion 22*a* of the second coil line 22. In this case, even if static electricity is applied from a side on which the second substantially columnar line 32 and the fourth substantially columnar line 34 lie, an electrostatic breakdown occurs easily between the second substantially columnar line 32 and the fourth substantially columnar line 34. This facilitates the identification of the location of a damaged portion to enable the lines to be routed more freely.

The minimum distance X2 is preferably about 0.8 or less times the minimum distance Y. In this case, the electrostatic breakdown of the base body 10 can be allowed to occur more reliably between the second substantially columnar line 32 and the fourth substantially columnar line 34.

The distance Ly where the first portion 21*a* of the first coil line 21 and the second portion 22*a* of the second coil line 22 arrange side by side with the minimum distance Y maintained therebetween is preferably longer than a distance L2 where the second substantially columnar line 32 and the fourth substantially columnar line 34 arrange side by side with the minimum distance X2 maintained therebetween. In this case, in the case where the distance Ly is long, it is difficult to identify the location of a damaged portion when an electrostatic breakdown occurs between the first coil line 21 and the second coil line 22; however, because an electrostatic breakdown occurs easily between the second substantially columnar line 32 and the fourth substantially columnar line 34, the location of the damaged portion is easily identified.

The distance Ly is preferably two or more times the distance L2, more preferably five or more times the distance L2. In this case, the distance Ly is two or more times the distance L2, preferably five or more times the distance L2. Thus, this further enhances the effect of enabling an electrostatic breakdown to occur easily between the second substantially columnar line 32 and the fourth substantially columnar line 34.

Each of the first substantially columnar line 31, the second substantially columnar line 32, the third substantially columnar line 33, and the fourth substantially columnar line 34 extends in a direction perpendicular to the first main surface 10*a*. In this case, it is possible to increase regions of the substantially columnar lines where the minimum distances X1 and X2 are maintained therebetween, thereby enabling an electrostatic breakdown to occur more reliably between the substantially columnar lines.

Production Method

A method for producing the inductor component 1 will be described below.

The first and second coil lines 21 and 22 are formed on the upper surface 61*b* of the insulating layer 61 by, for example, sputtering or electroless plating. Additionally, the first to fourth substantially columnar lines 31 to 34 extending upward from the first and second coil lines 21 and 22 are formed. Here, the first and second coil lines 21 and 22 and the first to fourth substantially columnar lines 31 to 34 are preferably formed by a semi-additive process, which provides high accuracy of the formation position and shape and small variations. In this case, each of the coil lines and the substantially columnar lines contains sulfur atoms or chlorine atoms in an amount of 0.1 atom % or more and 1 atom % or less (i.e., from 0.1 atom % to 1 atom %).

A magnetic sheet composed of a magnetic material is pressure-bonded to the upper surface 61*b* of the insulating layer 61 to form the second magnetic layer 12 on the insulating layer 61 so as to cover the first and second coil lines 21 and 22 and the first to fourth substantially columnar lines 31 to 34. The second magnetic layer 12 is ground to expose end faces of the first to fourth substantially columnar lines 31 to 34.

The insulating film 50 is then formed on the upper surface of the second magnetic layer 12. Through holes through which the end faces of the first to fourth substantially columnar lines 31 to 34 and the second magnetic layer 12 are exposed are formed in regions of the insulating film 50 where external terminals are to be formed.

The insulating layer 61 is removed by grinding. At this time, the insulating layer 61 is not completely removed, but is partially left. A magnetic sheet composed of a magnetic material is pressure-bonded to the ground lower surface 61*a* of the insulating layer 61 and ground into an appropriate thickness to form the first magnetic layer 11.

Then metal films extending from the first to fourth substantially columnar lines 31 to 34 to the through holes in the insulating film 50 are formed by electroless plating to form the first to fourth external terminals 41 to 44.

The present disclosure is not limited to the foregoing embodiment, and can be changed in design without departing from the gist of the present disclosure.

While the two lines, i.e., the first coil line 21 and the second coil line 22, are disposed in the base body 10 in the foregoing embodiment, three or more coil lines may be disposed. In this case, six or more external terminals and six or more substantially columnar lines are disposed. When three or more coil lines are disposed, it is sufficient that in at least one set of adjacent coil lines, the minimum distance between the at least one set of adjacent coil lines is shorter than the minimum distance between the first portion of the first coil line and the second portion of the second coil line.

In the foregoing embodiment, the "coil line (inductor line)" produces magnetic flux at the magnetic layer when a current flows, thereby imparting inductance to the inductor component. The structure, shape, material, and so forth thereof are not particularly limited. In particular, the coil line is not limited to a curved line extending on a plane (substantially spiral=two-dimensional curve) as described in the embodiment, and various known shaped lines, such as meander-shaped lines, may be used. The number of layers of coil lines is not limited to one, and a multilayer structure including two or more layers may be used. The shape of each substantially columnar line is a rectangle when viewed from the Z direction, but may be a circular shape, an elliptic shape, or an oval shape.

In the foregoing embodiment, the distance Ly is longer than each of the distances L1 and L2. However, the distance Ly may be shorter than at least one of the distances L1 and L2. In this case, the location of a portion of the base body where an electrostatic breakdown occurs can be reliably controlled to a location between adjacent substantially columnar lines.

EXAMPLES

Inductor components according to the above embodiment were actually produced. As illustrated in FIG. 2, regarding the size of each of the inductor components, the dimension in the Y direction was about 0.5 mm, the dimension in the X direction was about 2 mm, and the dimension in the Z direction was about 0.3 mm. The minimum distance X1 and the minimum distance X2 were equal to each other and defined as a minimum distance X. Inductor components of Examples 1 to 7 and a comparative example with different minimum distances X as given in Table 1 were produced. The minimum distance Y was about 100 μm. Each of the distances L1 and L2 was about 100 μm.

In Examples 1 to 7 and the comparative example, coil lines having a linear shape when viewed from the Z direction were used. An electrostatic discharge (ESD) test was performed. Table 1 presents the results of ESD evaluation. In the ESD test, ECDM-400EC, available from Tokyo Electronics Trading Co., Ltd., was used. A test method conformed to The Japan Electronics and Information Technology Industries Association (JEITA) Standard ED-4701/302. The evaluation voltage was about 4 kV for contact discharge. ESD was performed between adjacent coil lines.

TABLE 1

| | X | Y | ESD evaluation (n = 10) Breakdown between substantially columnar lines |
|---|---|---|---|
| Example 1 | about 30 μm | about 100 μm | about 100% |
| Example 2 | about 40 μm | about 100 μm | about 100% |
| Example 3 | about 50 μm | about 100 μm | about 100% |
| Example 4 | about 60 μm | about 100 μm | about 100% |
| Example 5 | about 70 μm | about 100 μm | about 100% |
| Example 6 | about 80 μm | about 100 μm | about 100% |
| Example 7 | about 90 μm | about 100 μm | about 40% |
| Comparative example | about 100 μm | about 100 μm | about 10% |

As presented in each of Examples 1 to 7 of Table 1, in the case where the minimum distance X was smaller than the minimum distance Y, breakdowns occurred between substantially columnar lines in about 40% or more of about 10 inductor components. The results indicated that the probability of the occurrence of the breakdowns between the substantially columnar lines was improved. As presented in each of Examples 1 to 6, in the case where the minimum distance X was about 80 μm or less, in other words, in the case where the minimum distance X was about 0.8 or less times the minimum distance Y, breakdowns occurred between the substantially columnar lines in all (about 100%) of the about 10 inductor components. The results indicated that the breakdowns were allowed to occur reliably between the substantially columnar lines.

In contrast, as presented in the comparative example, in the case where the minimum distance X was about 100 μm, i.e., in the case where the minimum distance X was equal to the minimum distance Y, a breakdown occurred between the substantially columnar lines in about 10% of about 10 inductor components. That is, the results indicated that in the comparative example, breakdowns occurred between the coil lines in about 90% of the about 10 inductor components.

Accordingly, it was possible to allow an electrostatic breakdown to occur between the substantially columnar lines in the base body by setting the minimum distance X to a value smaller than the minimum distance Y.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor component, comprising:

a base body;

a first coil line and a second coil line, each being disposed in the base body and parallel to a first main surface of the base body, the first and second coil lines being a pair of coil lines in a same inductor;

a first substantially columnar line and a second substantially columnar line, each being buried in the base body, having an end face exposed at a first main surface of the base body, and being electrically connected to the first coil line; and a third substantially columnar line and a fourth substantially columnar line, each being buried in the base body, having an end face exposed at the first main surface of the base body, and being electrically connected to the second coil line, wherein the first substantially columnar line is located closer to the third substantially columnar line than the fourth substantially columnar line, a minimum distance X1 between the first substantially columnar line and the third substantially columnar line is shorter than a minimum distance Y between a first portion of the first coil line and a second portion of the second coil line, the first portion of the first coil line being located between the first substantially columnar line and the second substantially columnar line when viewed from a direction perpendicular to the first main surface, the second portion of the second coil line being located between the third substantially columnar line and the fourth substantially columnar line when viewed from the direction perpendicular to the first main surface, and the first and second coil lines curve away from each other beginning at the end of their respective straight portions which extend from the first through fourth substantially columnar lines.

2. The inductor component according to claim 1, wherein the minimum distance X1 is about 0.8 or less times the minimum distance Y.

3. The inductor component according to claim 1, wherein a distance Ly where the first portion of the first coil line and the second portion of the second coil line arranged side by side with the minimum distance Y maintained therebetween is longer than a distance L1 where the first substantially columnar line and the third substantially columnar line arranged side by side with the minimum distance X1 maintained therebetween.

4. The inductor component according to claim 3, wherein the distance Ly is about five or more times the distance L1.

5. The inductor component according to claim 1, wherein the base body includes a magnetic layer composed of a resin containing a magnetic metal powder at least between the first portion of the first coil line and the second portion of the second coil line.

6. The inductor component according to claim 1, wherein the base body includes an insulating layer containing no magnetic material between the first portion of the first coil line and the second portion of the second coil line.

7. The inductor component according to claim 1, wherein a minimum distance X2 between the second substantially columnar line and the fourth substantially columnar line is shorter than the minimum distance Y between the first portion of the first coil line and the second portion of the second coil line.

8. The inductor component according to claim 1, wherein each of the first coil line and the second coil line contains sulfur atoms or chlorine atoms in an amount of from about 0.1 atom % to about 1 atom %.

9. The inductor component according to claim 1, wherein each of the first substantially columnar line, the second substantially columnar line, the third substantially columnar line, and the fourth substantially columnar line extends in a direction perpendicular to the first main surface.

10. The inductor component according to claim 2, wherein a distance Ly where the first portion of the first coil line and the second portion of the second coil line arranged side by side with the minimum distance Y maintained therebetween is longer than a distance L1 where the first substantially columnar line and the third substantially columnar line arranged side by side with the minimum distance X1 maintained therebetween.

11. The inductor component according to claim 2, wherein the base body includes a magnetic layer composed of a resin containing a magnetic metal powder at least between the first portion of the first coil line and the second portion of the second coil line.

12. The inductor component according to claim 3, wherein the base body includes a magnetic layer composed of a resin containing a magnetic metal powder at least between the first portion of the first coil line and the second portion of the second coil line.

13. The inductor component according to claim 2, wherein the base body includes an insulating layer containing no magnetic material between the first portion of the first coil line and the second portion of the second coil line.

14. The inductor component according to claim 3, wherein the base body includes an insulating layer containing no magnetic material between the first portion of the first coil line and the second portion of the second coil line.

15. The inductor component according to claim 2, wherein a minimum distance X2 between the second substantially columnar line and the fourth substantially columnar line is shorter than the minimum distance Y between the first portion of the first coil line and the second portion of the second coil line.

16. The inductor component according to claim 3, wherein a minimum distance X2 between the second substantially columnar line and the fourth substantially columnar line is shorter than the minimum distance Y between the first portion of the first coil line and the second portion of the second coil line.

17. The inductor component according to claim 2, wherein each of the first coil line and the second coil line contains sulfur atoms or chlorine atoms in an amount of from about 0.1 atom % to about 1 atom %.

18. The inductor component according to claim 3, wherein each of the first coil line and the second coil line contains sulfur atoms or chlorine atoms in an amount of from about 0.1 atom % to about 1 atom %.

19. The inductor component according to claim 2, wherein each of the first substantially columnar line, the second substantially columnar line, the third substantially columnar line, and the fourth substantially columnar line extends in a direction perpendicular to the first main surface.

* * * * *